US006953271B2

(12) United States Patent
Ayniéet al.

(10) Patent No.: US 6,953,271 B2
(45) Date of Patent: Oct. 11, 2005

(54) INDICATOR LAMP COMPRISING AN OPTICAL DEVICE FOR RECOVERING AND DISTRIBUTING THE LIGHT FLUX TOWARDS AN ANNULAR REFLECTOR

(75) Inventors: Jean-Pierre Aynié, Le Pre St. Gervate (FR); Jean-Claude Gasquet, Saint Clement (FR)

(73) Assignee: Valeo Vision, Bobigny Cedex (FR)

( * ) Notice: Subject to any disclaimer, the term of this patent is extended or adjusted under 35 U.S.C. 154(b) by 0 days.

(21) Appl. No.: 10/696,175

(22) Filed: Oct. 28, 2003

(65) Prior Publication Data

US 2004/0141323 A1 Jul. 22, 2004

(30) Foreign Application Priority Data

Oct. 28, 2002 (FR) ..... 02 11348

(51) Int. Cl.[7] ..... F21V 9/00

(52) U.S. Cl. ..... 362/511; 362/518; 362/522; 362/540; 362/327

(58) Field of Search ..... 362/511, 516–523, 362/540, 507–509, 326–327, 548–549, 459–460, 498, 514

(56) References Cited

U.S. PATENT DOCUMENTS

| | | | | | |
|---|---|---|---|---|---|
| 1,897,202 | A | * | 2/1933 | Lehman | 362/309 |
| 2,215,900 | A | * | 9/1940 | Bitner | 362/309 |
| 2,254,961 | A | * | 9/1941 | Lawrence | 362/327 |
| 3,799,652 | A | * | 3/1974 | Torguet | 359/313 |
| 4,177,505 | A | * | 12/1979 | Carel | 362/517 |
| 4,263,641 | A | * | 4/1981 | Ferrero | 362/293 |
| 4,506,315 | A | * | 3/1985 | Maekawa et al. | 362/308 |
| 4,905,133 | A | * | 2/1990 | Mayer et al. | 362/346 |
| 4,959,757 | A | * | 9/1990 | Nakata | 362/518 |
| 5,582,480 | A | * | 12/1996 | Zwick et al. | 362/298 |
| 5,704,709 | A | * | 1/1998 | Zwick et al. | 362/304 |
| 5,707,130 | A | * | 1/1998 | Zwick et al. | 362/517 |
| 6,273,591 | B1 | * | 8/2001 | Albou | 362/333 |
| 6,296,376 | B1 | * | 10/2001 | Kondo et al. | 362/310 |
| 6,402,356 | B2 | * | 6/2002 | Gotou | 362/543 |
| 6,447,155 | B2 | * | 9/2002 | Kondo et al. | 362/545 |
| 6,558,032 | B2 | * | 5/2003 | Kondo et al. | 362/516 |
| 2001/0010636 | A1 | * | 8/2001 | Gotou | 362/543 |
| 2002/0024818 | A1 | * | 2/2002 | Kondo et al. | 362/516 |
| 2002/0034081 | A1 | * | 3/2002 | Serizawa | 362/540 |
| 2004/0027833 | A1 | * | 2/2004 | Amano et al. | 362/507 |
| 2004/0120157 | A1 | * | 6/2004 | Bottesch et al. | 362/487 |

FOREIGN PATENT DOCUMENTS

| | | | | |
|---|---|---|---|---|
| DE | 202 06 829 | | 9/2002 | F21S/8/10 |
| EP | 0 380 663 | | 8/1990 | G02B/27/30 |
| EP | 1 182 395 | | 2/2002 | F21S/8/10 |
| GB | 531185 | * | 2/1940 | |
| GB | 531185 | | 12/1940 | |
| WO | WO 99/09349 | | 2/1999 | F21Q/1/00 |

* cited by examiner

*Primary Examiner*—Stephen Husar
*Assistant Examiner*—Jason Han
(74) *Attorney, Agent, or Firm*—Morgan & Finnegan, LLP

(57) ABSTRACT

The invention proposes an indicator lamp comprising an optical axis oriented from the rear to the front, on which there is a light source which is provided for emitting a light flux towards the front, and of the type comprising an optical device for recovering and distributing the rays of light emitted by the source, with a view to providing an indicating faction that meets the regulations, wherein the optical device comprises a coaxial annular reflector and, in front of the light source a central optical part known as the light engine which is provided for distributing the rays of light emitted by the source in directions that are generally transverse about the optical axis, towards the coaxial annular reflector that is provided for distributing the rays of light axially towards the front.

29 Claims, 8 Drawing Sheets

Fig. 3
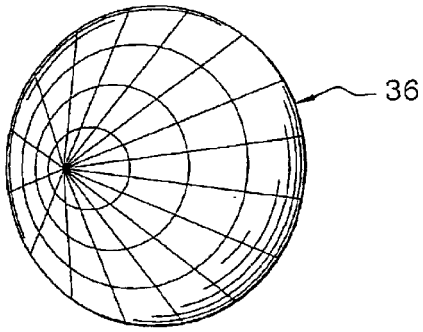
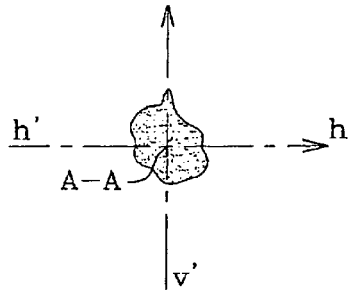
Fig. 4
Fig. 5
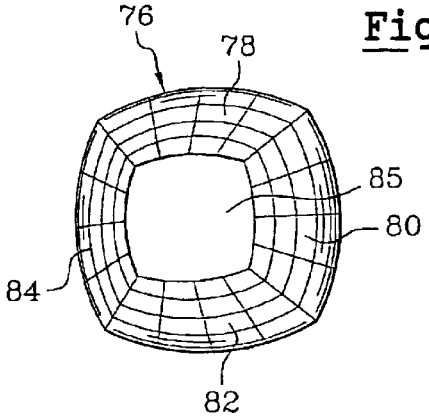
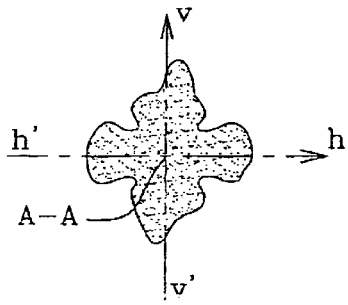
Fig. 6

INDICATOR LAMP COMPRISING AN OPTICAL DEVICE FOR RECOVERING AND DISTRIBUTING THE LIGHT FLUX TOWARDS AN ANNULAR REFLECTOR

BACKGROUND OF THE INVENTION

The invention proposes an indicator lamp, in particular for a motor vehicle.

The invention more particularly proposes an indicator lamp, in particular for a motor vehicle, comprising an optical axis oriented from the rear to the front, on which there is a light source which is provided for emitting a light flux towards the front, at a solid angle centred on the axis, and of the type comprising an optical device for recovering and distributing the rays of light emitted by the source, with a view to providing, towards the front, an indicating function that meets the regulations, the optical device comprising a coaxial annular reflector and, in front of the light source, a central optical part known as the light engine which is provided for distributing the rays of light emitted by the source in directions that are generally transverse about the optical axis, towards the coaxial annular reflector that is provided for distributing the rays of light, coming from the light engine, towards the front, generally in a direction parallel to the optical axis, so as to provide the indicating function that meets the regulations.

Such an indicator lamp is known, for example, from the document EP-A-1 182 395.

It will be recalled that the indicating functions of a vehicle lamp must meet regulations that define specific photometric conditions for each indicating function that is to be provided.

For example, in accordance with the regulations currently in force in Europe, an indicator lamp providing a fog-lamp function must form, on a measurement screen placed ten metres away, an image which has the general shape of a lozenge.

This lozenge is defined by characteristic points that are arranged on the measurement screen and that must each receive a light intensity the value of which must lie within a given range.

In the same way, an indicator lamp providing a reversing light function must form, on the measurement screen, a rectangle of given dimensions and the length of which is parallel to the horizontal plane.

New types of indicator lamp have been developed on the basis of light sources that are substantially punctiform which emit a light flux at a solid angle of given value. This type of light source is generally a light-emitting diode.

This type of light source is generally used in combination with a light conduit or guide.

The indicator lamps obtained from this combination have the drawback that they have an illumination range of great length, but of small width.

Moreover, this type of indicator lamp generally requires a number of light sources to provide a single indicating function.

SUMMARY OF THE INVENTION

The invention aims to remedy these drawbacks in particular, by proposing an indicator lamp that can have a small axial depth with respect to the overall width of the front opening of the lamp.

The indicator lamp according to the invention must allow the use of a light source that is substantially punctiform, such as a light-emitting diode, while having an acceptable luminance, so as to avoid dazzling users who may be looking in the direction of the indicator lamp.

For this purpose, the invention proposes an indicator lamp of the type described above, characterized in that the light engine is made of a transparent material having a refractive index greater than that of air, and in that the light engine comprises:

an inlet face which is arranged axially opposite the light source and the profile of which, in axial section, is such that most of the rays of light emitted by the source penetrate into the light engine;

an outlet face which is arranged generally radially opposite at least one axial section of the coaxial annular reflector;

at least one front inner reflection face which is provided to deflect, according to the principle of total reflection, at least part of the rays of light that enter the light engine, towards the outlet face, such that the rays of light leave the light engine by way of the outlet face by being refracted, and such that these rays of light strike the coaxial annular reflector at given angles of incidence.

According to other features of the invention:

the light engine comprises a rear inner reflection face of concave parabolic annular shape, which is focused on the light source and which reflects the rays of light axially towards the front;

the light engine comprises a front inner reflection face of convex parabolic annular shape, which is arranged axially opposite the rear reflection face and which is designed to cause the reflection of the rays of light, reflected by the rear reflection face, in a given direction towards an associated section of the outlet face;

the section of the outlet face that is associated with the parabolic front reflection face has a convex hemispherical annular shape, which is centred on the focus of the associated parabola such that the rays of light reflected by the parabolic front reflection face pass through the outlet face in a substantially orthogonal manner;

the light engine comprises a conical or frustoconical front reflection face which is centred on the optical axis such that the axial rays of light, which are reflected by the conical front face, strike the outlet face at an angle of incidence that is determined by the value of the angle at the vertex of the conical face;

the angle at the vertex of the conical face is substantially equal to ninety degrees, and the portion of the outlet face that is arranged radially opposite the conical face is substantially cylindrical, so that the rays of light reflected by the conical face pass through the outlet face in a substantially radial direction;

at least one axial section of a front reflection face is obtained by anamorphosis, with a view to producing a spatial distribution of the rays of light transmitted towards the reflector which is adapted to provide a given indicating function, for example a fog-lamp function;

the light engine comprises a peripheral annular portion which extends transversely outwards and which comprises a front outlet face provided with coaxial circular ridges along the optical axis, the ridges forming diopters designed to refract, axially towards the front, the rays of light coming from the inlet face;

the light engine comprises a front reflection face which is provided with catadioptric patterns that are designed to reflect, according to the principle of total reflection, the rays of light coming from the rear reflection face, towards the outlet face in a direction that is substantially orthogonal to the outlet face;

the outlet face is at least partly coincident with the rear reflection face;

each catadioptric pattern comprises two inclined faces which between them form an angle of given value, said faces being arranged with respect to the optical axis such that each ray parallel to the optical axis that strikes a catadioptric pattern is reflected on one of the two faces and then on the opposite face, according to the principle of total reflection, before being transmitted towards the outlet face;

each catadioptric pattern is truncated in the vicinity of the vertex of the angle formed by the two inclined faces, such that part of the rays of light that strike the catadioptric pattern are refracted towards the front, through the truncation;

the front reflection face has a coaxial annular shape, and the light engine comprises a front central outlet face, adjacent to the front reflection face, which is provided to refract the rays of light, coming from the light source, directly towards the front;

the front central outlet face comprises a series of elementary dioptric distribution elements which are provided so as to each form, from the rays of light passing through them, an elementary light beam that is directed towards the front;

the inlet face of the light engine comprises a concave hemispherical portion which is centred on the light source;

the inlet face comprises a central portion that forms a collimator, so as to refract the rays of light axially towards the front;

the light engine is made of a transparent material having a refractive index greater than that of air, and the light engine comprises:

a generally hemispherical inlet face which is centred on the light source and which comprises coaxial annular echelons provided for deflecting the rays of light by means of refraction;

an outlet face which is arranged generally radially opposite at least one axial section of the coaxial annular reflector;

such that the rays of light leave the light engine by way of the outlet face by being refracted, and such that these rays of light strike the coaxial annular reflector at given angles of incidence;

the outlet face of the light engine has a generally hemispherical shape centred on the source;

the light engine comprises a light diffusion face which is arranged axially opposite a central zone of the inlet face, so as to distribute, generally axially towards the front, part of the rays of light emitted by the source;

the front face of the coaxial annular reflector is reflective, and the front face comprises at least one axial section that is parallel to an associated axial section of the front reflection face of the light engine;

the front face of the reflector is reflective, and the front face comprises a series of elementary reflection facets that are oriented, with respect to the angle of incidence of the rays of light coming from the light engine, so as to reflect the rays of light, generally axially towards the front, thereby each forming an elementary light beam, the image of which, on a screen placed in front of the indicator lamp, corresponds to the indicating function to be provided;

the front face of the reflector is echeloned axially towards the front and transversely outwards;

the coaxial annular reflector is made of a transparent material having a refractive index greater than that of air; the profile of the front face of the reflector, with respect to the angle of incidence of the rays of light coming from the light engine, is such that said rays of light are refracted inside the reflector when they strike the front face of the reflector; and the rear face of the reflector is designed to reflect said rays of light towards the front, such that they are refracted through the front face in a generally axial direction;

the rear face of the reflector comprises a reflective coating;

the rear face of the reflector comprises a series of elementary reflection facets that are oriented in a given manner, with respect to the angle of incidence of the rays of light that are refracted inside the reflector through the front face;

the front face of the reflector comprises generally axial portions, which are arranged substantially orthogonally with respect to the direction of the rays of light coming from the light engine, and generally radial portions, which are located between two axial portions; the rear face of the reflector comprises axial sections that are substantially parallel to the associated sections of the front reflection face of the light engine, such that the rays of light coming from the light engine:

are refracted through the axial portions towards the inside of the reflector, without being deflected, then are reflected, axially towards the front, on the rear face of the reflector, then are refracted through the radial portions, towards the outside of the reflector, generally axially towards the front;

the rear face of the reflector comprises a series of catadioptric patterns having two faces, such that the rays of light coming from the light engine:

are refracted through the front face of the reflector, towards the inside of the reflector, then are reflected twice on a catadioptric pattern so as to be directed towards the front, then are refracted through the front face of the reflector, towards the outside of the reflector, generally axially towards the front;

the front face of the reflector comprises a series of elementary dioptric distribution elements which are designed to refract the rays of light, coming from the rear face of the reflector, thereby forming elementary light beams directed towards the front, the image of which, on a screen placed in front of the indicator lamp, corresponds to the indicating function to be provided;

the light engine is integrated in the device forming the light source.

BRIEF DESCRIPTION OF THE DRAWINGS

Other characteristics and advantages of the invention will emerge from the reading of the detailed description which follows, for an understanding of which reference will be made to the attached drawings, in which:

FIG. 3 is a perspective view from three-quarters of the way round to the rear, which schematically shows the frustoconical portion of the front reflection face of the light engine of FIG. 1;

FIG. 4 is a diagram which shows the distribution of the light in the light beam produced by the indicator lamp of FIG. 1;

FIG. 5 is a view similar to that of FIG. 3, which schematically shows a variant embodiment of the frustoconical portion of the light engine of FIG. 1;

FIG. 6 is a diagram similar to that of FIG. 4, which shows the distribution of the light in the light beam produced by an indicator lamp equipped with a frustoconical portion such as that of FIG. 5;

In the description which follows, elements that are substantially identical or similar shall bear identical references.

DETAILED DESCRIPTION

FIGS. 1 to 8 show an indicator lamp 10 which is produced in accordance with a first embodiment of the invention.

The indicator lamp 10 comprises an optical device 12 for recovering and distributing the rays of light emitted by a light source 14, which is in this case formed by a light-emitting diode.

The optical device 12 here has an overall shape of revolution about an optical axis A—A.

Figure 1:
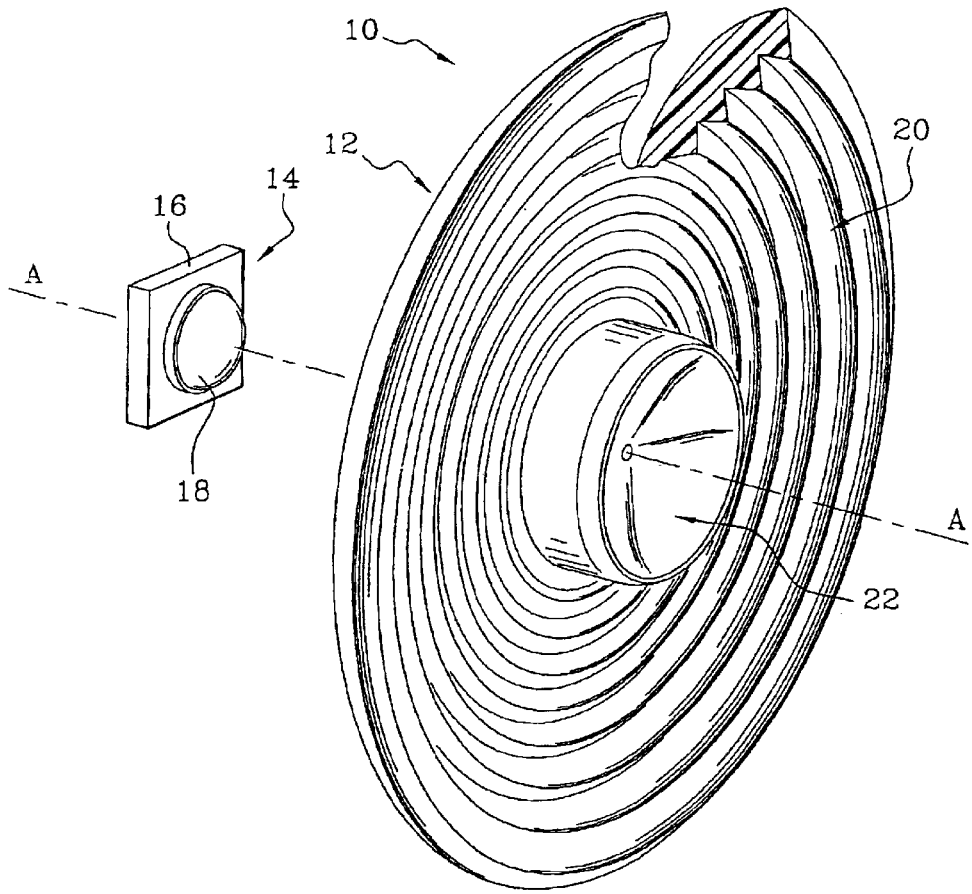
FIG. 1 is an exploded perspective view from three-quarters of the way round to the front, which schematically shows an indicator lamp equipped with a light engine according to a first embodiment of the invention.
Figure 2:
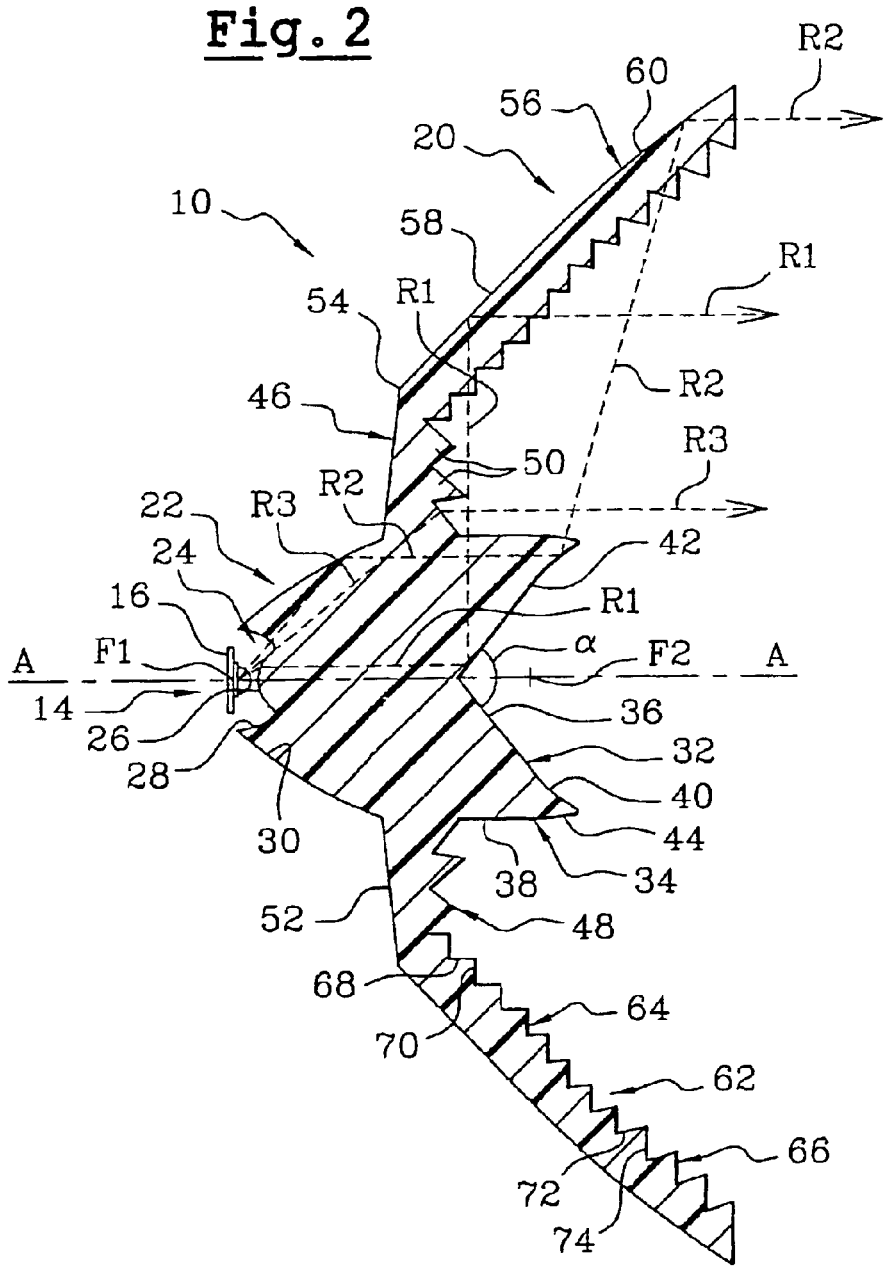
FIG. 2 is a view in axial section which schematically shows the indicator lamp of FIG. 1.

In the rest of the description, an axial orientation from the rear to the front, which corresponds to an orientation from left to right on the optical axis A—A shown in FIG. 2, will be used in a non-limiting manner.

In a non-limiting manner, elements will be qualified as outer or inner depending on whether they are arranged radially towards the optical axis A—A or away from this axis.

The diode 14 is arranged on the optical axis A—A, behind the optical device 12.

The diode 14 has been shown mounted on a support board 16 which in particular allows it to be connected to an electrical power supply network and to a control unit (which are not shown).

Advantageously, a diode 14 known as a high-power diode is used, that is to say a diode whose light power is of several tens of lumens, for example more than thirty lumens, which is to be compared with the power of less than ten lumens of diodes known as low-power diodes. The use of such a diode 14 makes it possible, in particular, to provide the indicating function using just a single light source for each indicator lamp 10.

High-power diodes 14 are available in several colours, that is to say that it is possible to choose the colour of the light flux emitted by the diode 14. Preferably, the colour of the diode 14 will be chosen depending on the indicating function to be provided, for example red for a fog-lamp function or white for a reversing function.

The diode 14 comprises at the front a hemispherical diffusion globe 18 which is centred on the axis A—A and which is convex towards the front.

By approximation, the diode 14 will be assimilated to a punctiform source which is located on the optical axis A—A and which emits its light flux towards the front, at a solid angle of around 180°, centred on the axis A—A.

According to the embodiment shown here, the optical device 12 is made of a transparent material having a refractive index greater than that of air, which in this case constitutes the ambient environment surrounding the optical device 12.

Advantageously, the optical device 12 is in this case made in a single piece by moulding and by machining, of a transparent plastic material such as, for example, polymethyl methacrylate (PMMA).

The optical device 12 comprises a coaxial annular reflector 20 and a central optical part known as the light engine 22.

The light engine 22 is provided to distribute the rays of light, emitted by the diode 14, in directions that are generally transverse about the optical axis A—A, towards the coaxial annular reflector 20.

In the present description, the adjective "transverse" is used to qualify a direction that is close to a radial direction, with respect to the optical axis A—A. A transverse ray of light may therefore be slightly inclined towards the rear or towards the front with respect to a radial direction.

The coaxial annular reflector 20 is provided to distribute the rays of light, coming from the light engine 22, towards the front, generally in a direction parallel to the optical axis A—A, so as to provide an indicating function that meets the regulations.

The light engine 22 comprises an inlet face 24, which is arranged axially opposite the globe 18 of the diode 14.

The profile of the inlet face 24, in axial section, is such that most of the rays of light emitted by the diode 14 penetrate into the light engine 22.

The inlet face 24 comprises a coaxial central portion 26 that forms a collimator, which has a shape that is generally hemispherical and convex towards the rear, and a coaxial annular peripheral portion 28, which has a shape that is generally hemispherical and concave towards the front.

The hemispherical profile of the central portion 26 of the inlet face 24 is such that most of the rays of light received, from the diode 14, are refracted inside the light engine 22 by being deflected, so that these rays of light penetrate into the light engine 22 in a direction that is substantially parallel to the optical axis A—A.

The peripheral hemispherical portion 28 of the inlet face 24 is centred on the diode 14, so that most of the rays of light received by the portion 28, from the diode 14, are refracted inside the light engine 22 without being deflected.

The light engine 22 comprises a rear reflection face 30 of concave parabolic annular shape.

The rear reflection face 30 is designed to reflect axially towards the front, according to the principle of total reflection, the rays of light that enter the light engine 22 by way of the peripheral portion 28 of the inlet face 24. For this purpose, the focus F1 of the parabola forming the rear reflection face 30 is substantially coincident with the light source 14.

The light engine 22 comprises a front reflection face 32 of coaxial and convex conical general shape.

The front reflection face 32 is designed to reflect, according to the principle of total reflection, the rays of light that pass into the light engine 22, towards an outlet face 34.

The front reflection face 32 comprises a conical central portion 36 which is in this case arranged axially opposite the inlet face 24 and axially opposite part of the rear reflection face 30.

The angle at the vertex a of the conical portion 36 is in this case about ninety degrees, so that the rays of light which strike this portion 36, and which are parallel to the optical axis A—A, are reflected radially outwards.

Advantageously, the axial section 38 of the outlet face 34, which is arranged radially opposite the conical portion 36, has a substantially cylindrical shape, so that the radial rays of light that are reflected by the conical portion 36 are substantially orthogonal to the axial section 38 of the outlet face 34, so that they pass through the outlet face 34 generally without being deflected.

The front reflection face 32 comprises a peripheral annular portion 40 which is adjacent to the conical portion 36 and which is arranged axially opposite part of the rear reflection face 30.

The peripheral annular portion 40 has a generally parabolic shape, the focus F2 of the parabola being arranged in this case on the optical axis A—A, axially at the level of the connection 42 between the conical portion 36 and the parabolic portion 40.

Thus, the axial rays of light which strike the parabolic portion 40 of the front reflection face 32 are reflected outwards, in a direction passing through the focus F2.

Advantageously, the axial section 44 of the outlet face 34, which is arranged radially opposite the parabolic portion 40, has a substantially hemispherical shape centred on the focus F2, such that the rays of light that are reflected outwards by the parabolic portion 40 are substantially orthogonal to the axial section 44 of the outlet face 34 so that they pass through the outlet face 34 without being deflected.

It will be noted that the inlet face 24, the reflection faces 30, 32 and the outlet face 34 are located at the interface between the transparent material constituting the light engine 22 and the ambient air. The reflection faces 30, 32 are respectively denoted concave and convex, from the point of view of the rays of light that pass into the light engine 22.

According to the embodiment shown in FIG. 2, the light engine 22 comprises a peripheral annular portion 46 which extends transversely outwards. This annular portion 46 is in this case arranged axially between the rear reflection face 30 and the cylindrical section 38 of the outlet face 34.

The annular portion 46 comprises a front outlet face 48 which is generally transverse and which is provided with circular ridges 50 that are coaxial, along the optical axis A—A, and form refractive diopters. The circular ridges 50 are designed to refract, axially towards the front, part of the rays of light coming from the peripheral portion 28 of the inlet face 24.

It will be noted that the rear face 52 of the annular portion 46 is in this case neutral in optical terms, since it is not provided to receive rays of light coming from the source 14.

The coaxial annular reflector 20 in this case extends axially towards the front, and transversely outwards, from the outer peripheral edge 54 of the annular portion 46.

The rear face 56 of the reflector 20 comprises a frustoconical rear axial section 58, having an angle at the vertex equal to that ($\alpha$) of the conical portion 36 of the light engine 22, which is arranged radially opposite the cylindrical section 38 of the outlet face 34 of the light engine 22.

The frustoconical section 58 in this case extends axially beyond the cylindrical section 38, towards the rear, in order to connect with the annular portion 46 of the light engine 22.

The rear face 56 of the reflector 20 comprises a substantially parabolic front axial section 60, which is adjacent to the frustoconical section 58. The focus of the parabola corresponding to the parabolic section 60 is substantially coincident with the focus F2, so that the rays of light leaving the light engine 22 by way of the hemispherical section 44 of the outlet face 34 are reflected, axially towards the front, by the parabolic section 60.

The front face 62 of the reflector 20 is echeloned axially, from the rear to the front, and transversely, from the inside to the outside. It comprises a rear axial section 64, which is arranged radially opposite the frustoconical section 38 of the outlet face 34 of the light engine 22, and a front axial section 66.

The rear section 64 of the front face 62 delimits, in axial section, a series of "steps", each comprising an axial portion 68 and a radial portion 70.

As the rear section 64 is arranged opposite the cylindrical section 38, it receives radial rays of light coming from the light engine 22, which pass through the axial portions 68 in an orthogonal manner.

The front section 66 of the front face 62 delimits, in axial section, a series of "steps", each comprising a hemispherical portion 72, which is centred on the focus F2, and a radial portion 74.

The rays of light coming from the hemispherical portion 44 of the outlet face 34 of the light engine 22 strike the front section 66 in a manner orthogonal to the hemispherical portions 72.

The front section 66 extends axially towards the front, beyond the light engine 22, so as to collect most of the rays of light that leave the light engine 22 by way of the hemispherical portion 44 of the outlet face 34.

The mode of operation of the indicator lamp 10 according to the invention will now be explained, with a description in particular being given of the path of some representative rays of light.

The rays of light R1, which are emitted by the diode 14 at a solid angle centred on the optical axis A—A and delimited by the circumferential edge of the central portion 26 of the inlet face 24, are refracted through the central portion 26 that forms a collimator, such that they penetrate into the light engine 22 in a direction parallel to the optical axis A—A.

The rays R1 then strike the conical portion 36 of the front reflection face 32. Since this conical portion 36 forms an angle of ninety degrees, the rays R1 are reflected outwards in a radial direction.

After having been reflected on the conical portion 36, the rays R1 are refracted through the cylindrical portion 38 of the outlet face 34, without being deflected.

In the same way, the rays R1 are then refracted through the axial portions 68 opposite the rear section 64 of the front face 62 of the reflector 20, without being deflected. The rays of light R1 then strike the frustoconical section 58 of the rear face 56 of the reflector 20, which reflects these rays R1 axially towards the front.

The rays R1 leave the reflector 20 by way of the radial portions 70 or 74 of the front face 62, in generally axial directions.

Among the rays of light emitted by the diode 14 that enter the light engine 22 by way of the peripheral portion 28 of the inlet face 24, part R2 are reflected on the rear reflection face 30, in an axial direction, since the focus F1 of the parabola forming the rear reflection face 30 is coincident with the centre of the diode 14.

The rays of light R2 are then reflected either on the conical portion 36 of the front reflection face 32 or on the parabolic portion 40 of the front reflection face 32.

In the case where the rays R2 strike the conical portion 36, they then follow the same type of trajectory as the rays R1, leaving the light engine 22 by way of its cylindrical section 38, in a substantially radial direction.

In the case where the rays R2 strike the parabolic portion 40, then they are reflected towards the hemispherical portion 44 of the outlet face 34, in a direction passing through the focus F2.

Since the centre of the hemispherical portion 44 is coincident with the focus F2, the rays R2 then pass through the hemispherical portion 44 without being deflected.

The rays R2, which leave the light engine 22 by way of the hemispherical portion 44, enter the reflector 20 by being refracted through the hemispherical portions 72 of the front section 66 of its front face 62.

Since the hemispherical portions 72 of the front face 62 are centred on the focus F2, the rays R2 enter the reflector 20 without being deflected, and they are reflected, axially towards the front, on the parabolic section 60 of the rear face 56 of the reflector 20.

The rays R2 leave the reflector 20 by being refracted axially through the radial portions 74 of the front section 66 of the front face 62.

Another part R3 of the rays of light that enter the light engine 22 by way of the peripheral portion 28 of the inlet face 24 directly strike the circular ridges 50 of the transverse portion 46 of the light engine 22. The circular ridges 50 cause the refraction of the rays R3, axially towards the front.

The rays R3 are therefore emitted directly towards the front by the light engine 22, without passing through the reflector 20.

According to the embodiment shown here, it will be noted that no ray of light is provided for being emitted axially in the vicinity of the optical axis A—A, on account of the presence of the light engine 22 which distributes the rays of light coming from the diode 14 in a generally transverse manner towards the reflector 20.

Advantageously, in order to avoid the formation of a "black hole" at the centre of the light beam produced by the indicator lamp 10, provision is made to produce the light engine 22 while allowing machining and/or polishing imperfections to remain on its outer surface, which corresponds to the front reflection face 32, so that part of the rays of light passing into the light engine 22 are refracted directly axially towards the front, through the front reflection face 32.

FIG. 3 schematically shows, in perspective, the frustoconical portion 36 of the front reflection face 32 of the light engine 22, and FIG. 4 schematically shows the spatial distribution of the light beam produced by the indicator lamp of FIG. 2, on a screen placed in front of it.

On account of the shape of revolution of the indicator lamp 10 shown in FIG. 2, a light distribution that is substantially uniform and centred on the axis A—A is obtained on the screen.

Such a light distribution is not suited to all indicating functions that meet the regulations; in particular, it is not suited to a fog-lamp function, which must form a beam that has the general shape of a lozenge or a cross.

For this purpose, the invention advantageously proposes that at least one axial section of the front reflection face 32 be obtained by anamorphosis, so that the distribution of the rays of light towards the reflector 20 is not uniform in all transverse directions about the optical axis A—A.

FIG. 5 schematically shows, in perspective, a portion 76 of the front reflection face 32 which is obtained by anamorphosis and which is provided to replace the conical portion 36 shown in FIGS. 2 and 3.

The reflection face portion 76 in this case comprises four adjacent faces 78, 80, 82, 84 which are distributed uniformly about the optical axis A—A and which generally have the same dimensions. Each face 78, 80, 82, 84 generally corresponds to a frustoconical face portion.

Of course, the parabolic portion 40 of the front reflection face 32 may also be replaced by a surface obtained by anamorphosis. Such a surface would then comprise four faces in the form of a portion of a parabola.

FIG. 6 schematically shows the shape of the light beam obtained using an indicator lamp 10 comprising an "anamorphosed" front reflection face 32.

The light beam forms a cross. Each branch of the cross corresponds to part of the light flux which has passed through one of the faces 78, 80, 82, 84 of the reflection face portion 76.

It will be noted that the reflection face portion 76 delimits a radial central face 85 that allows the refraction of part of the rays of light directly towards the front, in the vicinity of the optical axis A—A, so as to avoid the presence of a "black hole" at the centre of the light beam.

According to a variant embodiment (not shown) of the invention, an indicating beam of specific shape that meets the regulations is produced, in particular a fog-lamp, by arranging, on the radial portions 70, 74 of the front face 62 of the reflector 20 and/or on the circular ridges 50, elementary dioptric patterns or toric patterns that are provided to form, individually, an elementary light beam the shape of which is suited to the indicating function that is to be provided. Such dioptric patterns will be described in more detail later, with reference to another embodiment.

It will be noted that the embodiment of the indicator lamp 10 shown in FIG. 2 does not require any reflective coating, since use is made of the properties of total reflection of the light inside the transparent material constituting the optical device 12.

Figure 7:
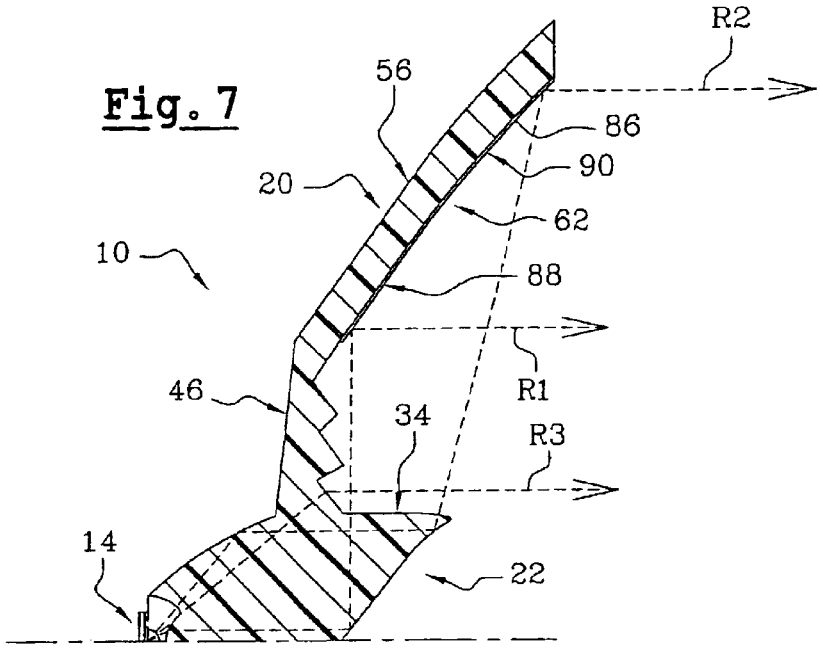
FIG. 7 is a partial view in axial section which shows a first variant embodiment of the indicator lamp of FIG. 1.
Figure 8:
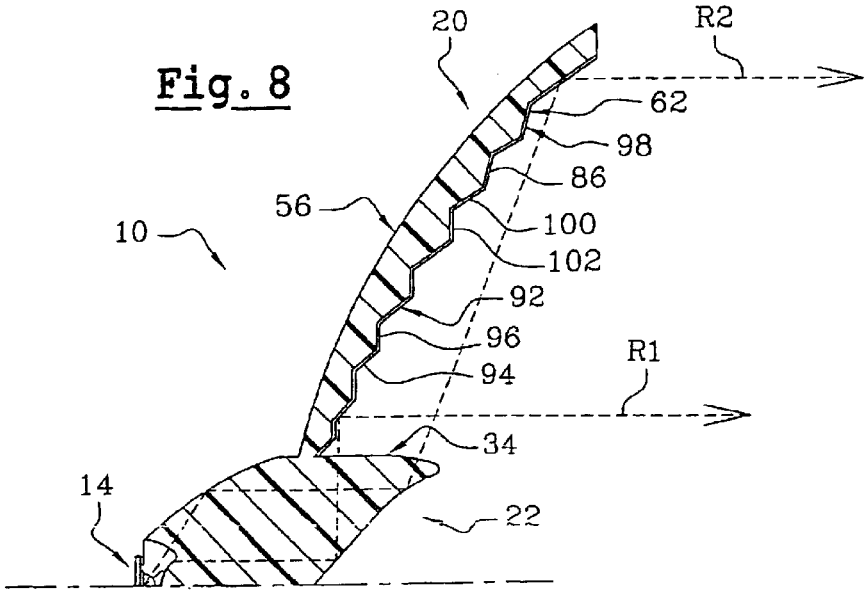
FIG. 8 is a view similar to that of FIG. 7, which shows a second variant embodiment of the indicator lamp of FIG. 1.

FIGS. 7 and 8 show two variants of the first embodiment of the invention, in which the shape of the reflector 20 has been modified. In these variants, the front face 62 of the reflector 20 is coated with a reflective material 86, for example one based on aluminium.

According to the first variant, which is shown in FIG. 7, the profile of the front face 62, in axial section, generally corresponds to the profile of the rear face 56 of FIG. 2, that is to say that the front face 62 comprises a frustoconical rear axial section 88, which is arranged radially opposite the cylindrical portion 38 of the light engine 22, and a parabolic front axial section 90.

According to this first variant, the rays of light which leave the light engine 22 by way of its outlet face 34 are reflected directly on the front face 62 of the reflector 20, and they are generally sent back axially towards the front.

According to the second variant, which is shown in FIG. 8, the front face 62 of the reflector 20 comprises a rear axial section 92 which is echeloned and which comprises annular facets 94 of frustoconical profile, so as to reflect, axially towards the front, the radial rays of light R1 coming from the cylindrical section 34 of the light engine 22.

The facets 94 are in this case separated by radial portions 96.

The front face 62 also comprises a front axial section 98 which is echeloned and which comprises annular facets 100 of generally parabolic profile, so as to reflect, axially towards the front, the rays of light R2 coming from the hemispherical section 44 of the outlet face 34 of the light engine 22.

The facets 100 are in this case separated by portions 102 that are inclined towards the front and outwards.

It will be noted that, according to the variant embodiments of FIGS. 7 and 8, the rear face 56 of the reflector 20 does not fulfil any optical function, and it may therefore have any profile whatsoever.

For example, in FIG. 8, the profile of the rear face 56 of the reflector 20 is generally hemispherical.

Moreover, the portions 96 and 102 are in this case not designed to receive and reflect rays of light coming from the engine 22, which is why they are arranged outwith the path of the rays of light R1, R2.

Of course, other variant embodiments (not shown) are conceivable. In particular, it is possible to produce the light engine 22 and the reflector 20 in the form of two distinct parts, it being possible for the reflector 20 to be made for example of a material that is not transparent, but is coated with a reflective material on its front face 62, in accordance with the variant embodiments shown in FIGS. 7 and 8.

In the description of the other embodiments of the invention, a description will be given primarily of the elements of the indicator lamp 10 that differ from the first embodiment, or from the preceding embodiment.

A description will now be given, with reference to FIGS. 9 to 13, of an indicator lamp 10 that is produced in accordance with a second embodiment of the invention.

The inlet face 24 of the light engine 22 in this case has a hemispherical shape, which is concave towards the front and is centred on the diode 14. The inlet face 24 is in this case complementary to the hemispherical globe 18 of the diode 14.

The light engine 22 comprises a rear reflection face 104 of generally parabolic shape, which is similar to the rear reflection face 30 of the first embodiment.

The focus F1 of the parabola corresponding to the rear reflection face 104 is in this case arranged at the centre of the diode 14, so that the rays of light, which enter the light engine 22 without being deflected, are reflected axially towards the front by the rear reflection face 104.

The light engine 22 comprises a front reflection face 32 of generally frustoconical shape, the vertex of the frustum of the cone being arranged at the rear.

The front reflection face 32 delimits, at its rear axial end, a radial central light diffusion face 106.

Advantageously, the central diffusion face 106 comprises a series of elementary dioptric patterns 108, which are provided to form, individually, from the rays of light that they receive on their rear face, an elementary light beam which is directed generally axially towards the front and the shape of which is suited to the indicating function to be provided.

Each elementary dioptric pattern 108 can be likened to a diopter, or prism, and it forms a domed facet, which is in this case concave towards the rear.

The concave or curved shape of the face forming each dioptric pattern 108 is determined so that the rays of light, coming from the inlet face 24 of the light engine 22, are refracted through the dioptric pattern 108, thereby being distributed spatially towards the front and forming at the front a beam of light that provides the chosen indicating function.

For example, if the indicator lamp 10 is provided for a fog-lamp function, then each dioptric pattern 108 deflects and distributes the rays of light that it receives so as to produce at the front, on a measurement screen, a generally lozenge-shaped image.

The front reflection face 32 comprises a series of elementary "catadioptric" patterns 110, which are in this case distributed uniformly about the optical axis A—A.

The front reflection face 32 in this case comprises three concentric annuluses 112, 114, 116, each formed by a series of circumferentially adjacent catadioptric patterns 110.

Figures 10, 11:
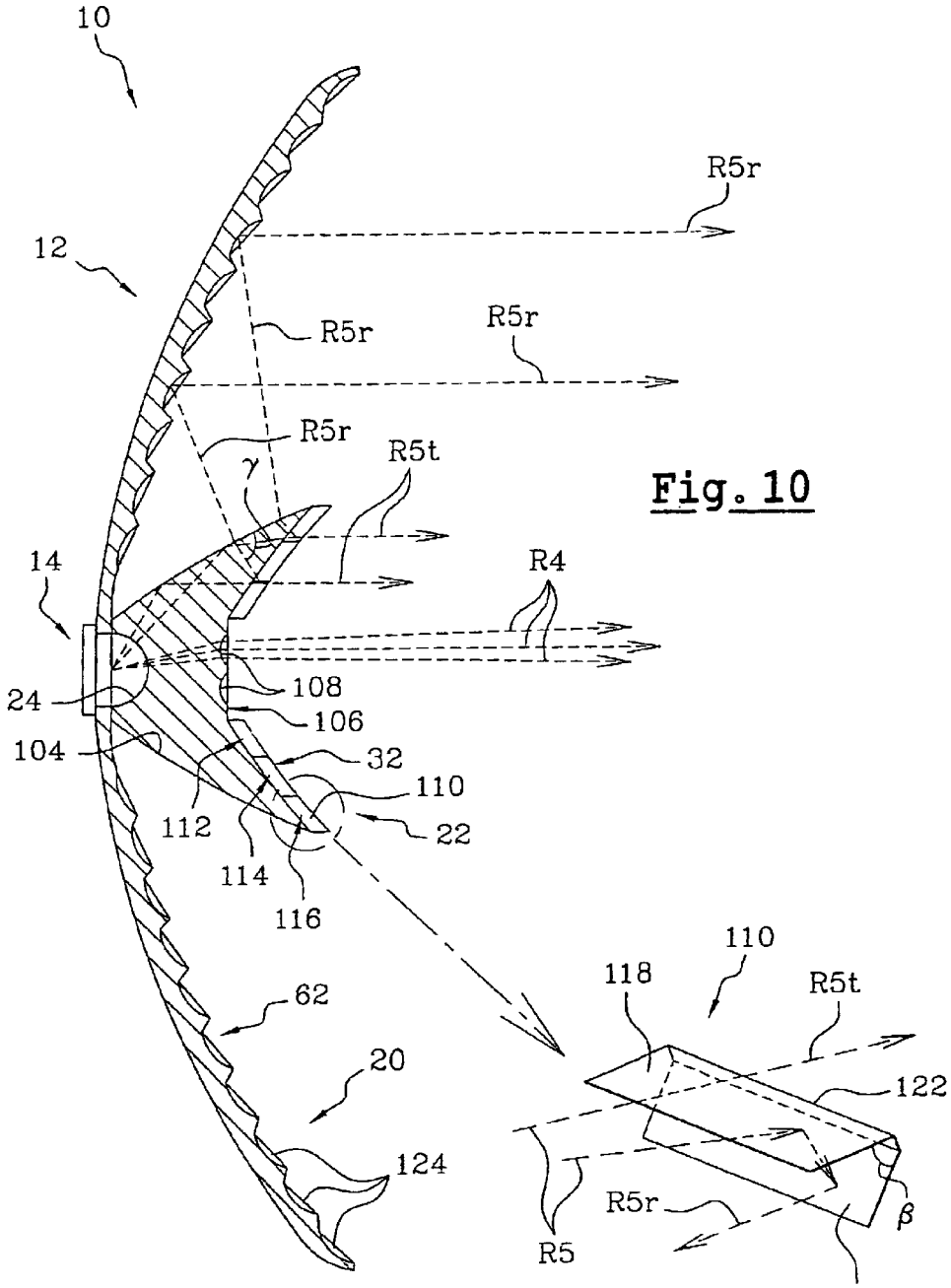
FIG. 10 is a view in axial section which schematically shows the indicator lamp of FIG. 9.
FIG. 11 is a perspective view which schematically shows a catadioptric pattern belonging to the light engine of the indicator lamp of FIG. 9.

As can be seen in the detailed view of FIG. 11, each catadioptric pattern 110 comprises two flat faces 118, 120 which are inclined with respect to one another by an angle β of around forty-five degrees. The angle β promotes reorientation of the ray R5*r* towards the zones of the reflector.

Preferably, the angle formed by the two inclined faces 118, 120 comprises a truncation which forms a straight facet 122 that extends over the entire length of the catadioptric pattern 110.

The facet 122 is generally parallel to the general frustoconical shape of the front reflection face 32, and it is arranged in front of the catadioptric pattern 110.

Each catadioptric pattern 110 extends generally over the entire axial thickness of the associated annulus 112, 114, 116. Each annulus 112, 114, 116 therefore forms, in front of the light engine 22, an "accordion-shaped" annular face.

The outlet face 34 of the light engine 22 is in this case coincident with the rear reflection face 104, as will be understood below in the explanation of the mode of operation of the light engine 22 according to the second embodiment.

Figure 9:
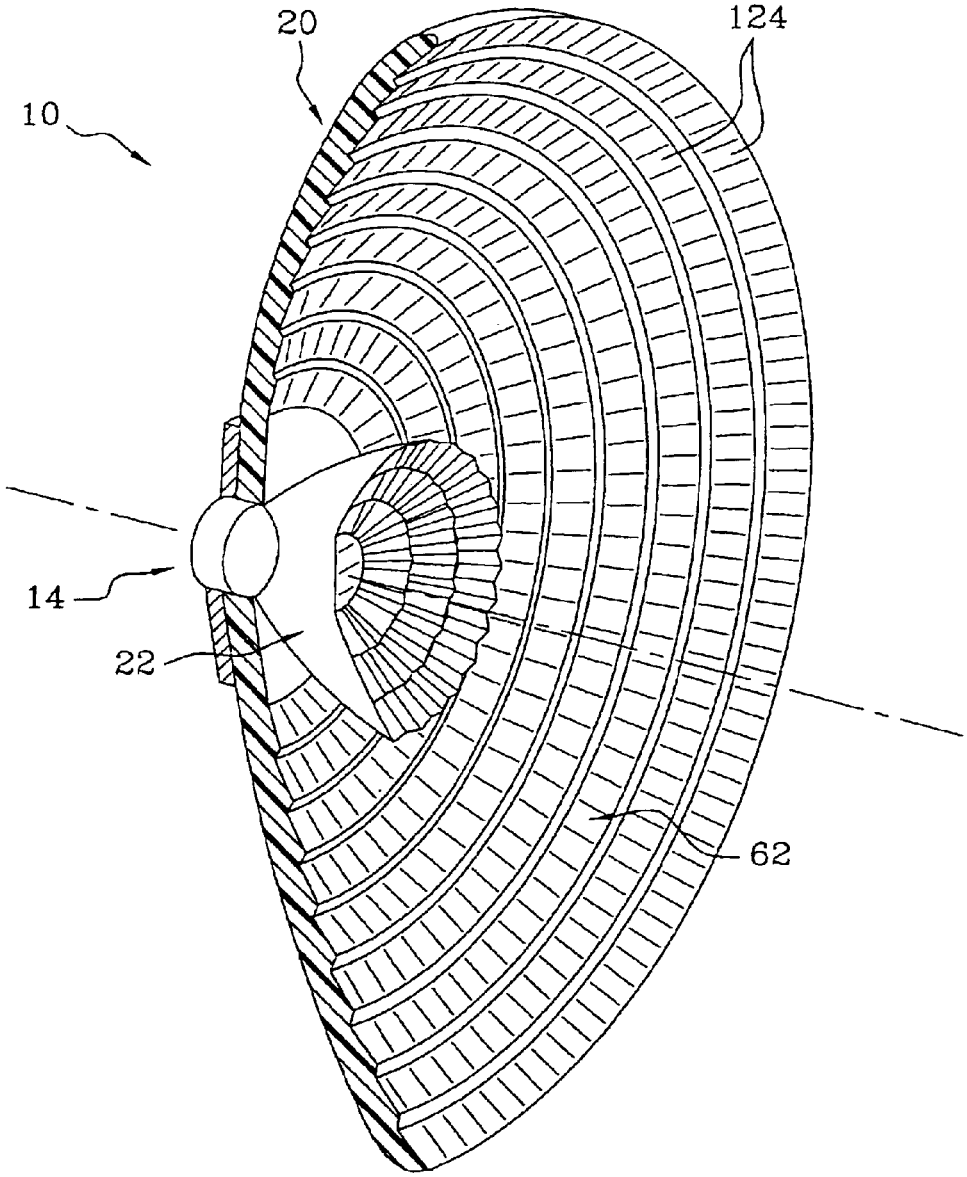
FIG. 9 is a perspective view from three-quarters of the way round to the front, with cutaway, which schematically shows an indicator lamp equipped with a light engine according to a second embodiment of the invention.

The annular reflector 20, according to the embodiment shown in FIGS. 9 and 10, has a profile that is generally similar to that of the annular reflector 20 of FIG. 8. The annular reflector 20 therefore comprises a front reflection face 62 that is stepped axially towards the front and radially outwards and that is coated with a reflective material.

The front face 62 comprises elementary reflection facets 124. These reflection facets 124 are in this case generally inclined towards the front and outwards, so as to reflect, generally axially towards the front, the rays of light coming from the outlet face 104 of the light engine 22.

The reflection facets 124 are in this case arranged in the form of concentric annuluses 126, and they are distributed over the circumference so that they are circumferentially adjacent in pairs.

Each reflection facet 124 is domed, and in this case it has a profile that is generally concave towards the rear. The concave or curved shape of the face forming each reflection facet 124 is generally determined in the same manner as the shape of the dioptric patterns 108 of the central diffusion face 106.

The shape and inclination of the reflection facets 124 takes account of the angle of incidence of the rays of light, coming from the light engine 22, on the front face 62 of the reflector 20. This angle of incidence depends in particular on the axial position of the facets 124 with respect to the outlet face 104 of the light engine 22.

Moreover, mathematical algorithms make it possible to calculate, by progressive "morphing", the appropriate shape for each reflection facet 124, as a function of its angular position about the optical axis A—A.

The mode of operation of the indicator lamp 10 according to the second embodiment is as follows.

The rays of light emitted by the diode 14 penetrate into the light engine 22 by passing through the inlet face 24 without being deflected, since the hemisphere forming the inlet face 24 is centred on the diode 14.

A first part R4 of the rays of light, those which are closest to the optical axis A—A, strike the central diffusion face 106, where the rays R4 are transmitted directly towards the front, through the dioptric patterns 108, thereby forming elementary beams of a shape suited to the indicating function of the lamp 10.

A second part R5 of the rays of light are reflected axially towards the front by the rear reflection face 104. These rays of light R5 then strike the catadioptric patterns 110.

As shown in FIG. 11, part R5*r* of the rays of light R5 are reflected a first time on a face 118 of a catadioptric pattern 110, then a second time on the other face 120 of the catadioptric pattern 110, such that the rays of light R5*r* are finally sent back by way of the catadioptric pattern 110 towards the rear reflection face 104.

The rays of light R5*r*, which are reflected by the catadioptric patterns 110, strike the rear reflection face 104 at an angle of incidence $\gamma$ that is close to ninety degrees, so that they are refracted through this face 104 that becomes the outlet face.

The rays of light R5*r* leave the light engine 22 by way of the outlet face 104 in directions that are inclined towards the rear and oriented outwards.

The rays R5*r* then strike the reflection facets 124 of the annular reflector 20, on which facets they are reflected so as to form towards the front a series of elementary beams, the shape of which is suited to the indicating function of the lamp 10.

As shown in FIG. 11, part R5*t* of the rays of light R5 are refracted through the facet 122 of the catadioptric pattern 110, and this part R5*t* are therefore transmitted directly towards the front.

The facets 122, which are produced in the catadioptric patterns 110, make it possible to allow a minimum of light to pass through the front reflection face 32, so as to obtain a light distribution that is substantially uniform in front of the indicator lamp 10.

Figure 12:
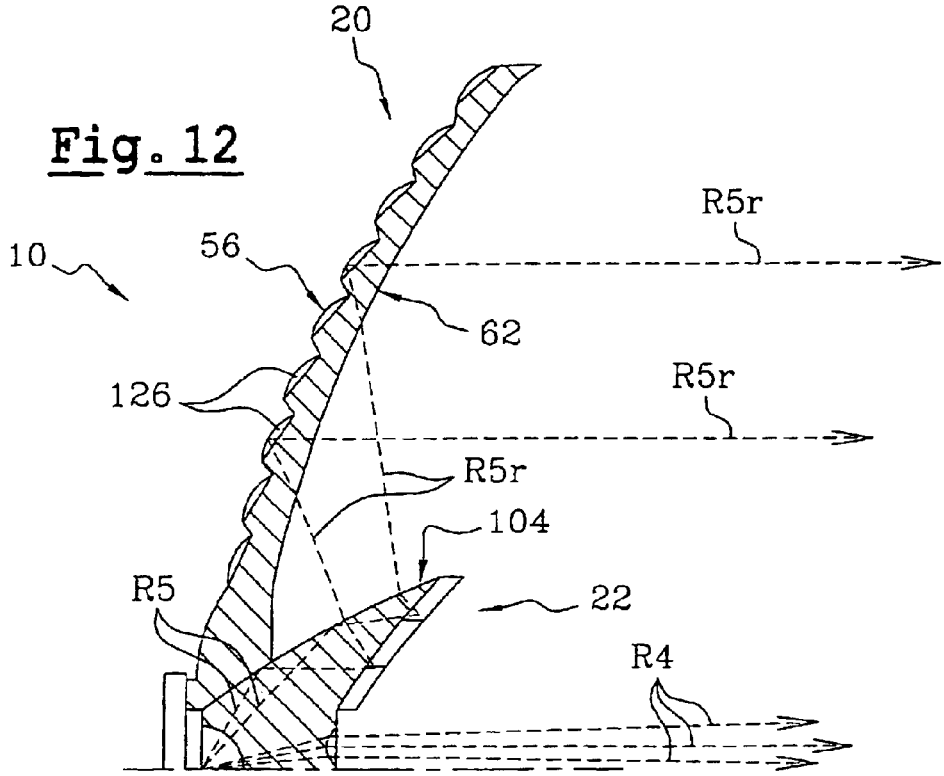
FIG. 12 is a partial view in axial section which schematically shows a first variant embodiment of the indicator lamp of FIG. 9.
Figure 13:
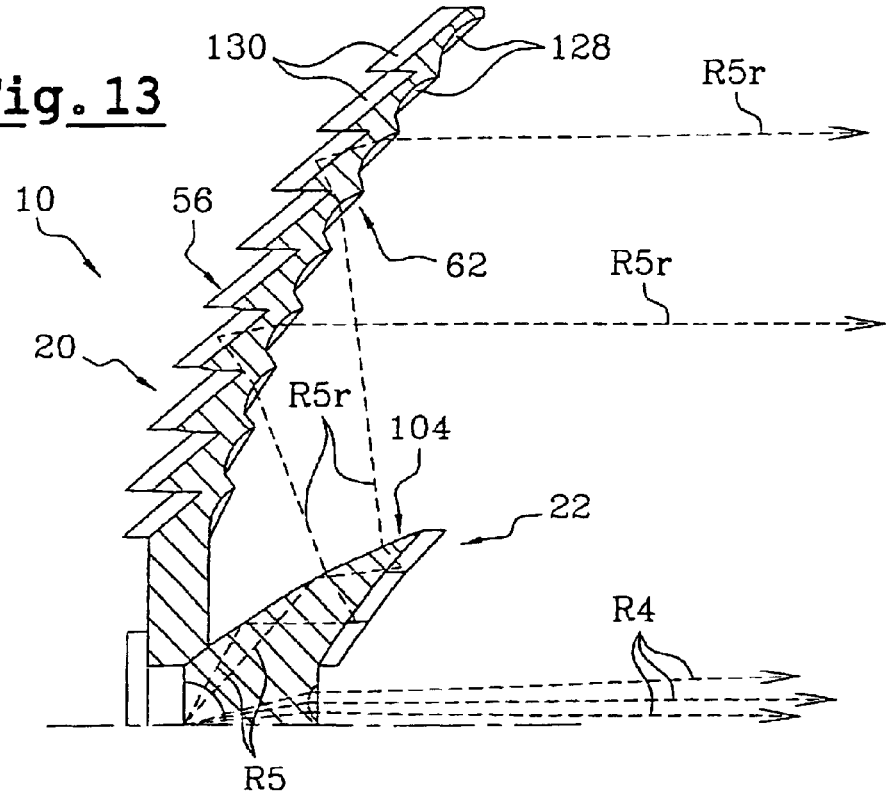
FIG. 13 is a view similar to that of FIG. 12, which schematically shows a second variant embodiment of the indicator lamp of FIG. 9.

FIGS. 12 and 13 show a first and a second variant of the indicator lamp 10 according to the second embodiment.

In these two variants, the light engine 22 is similar to that described with reference to FIGS. 9 to 11, but the annular reflector 20 is different. The annular reflector 20 is in this case made of a transparent material, and the rays of light R5*r* coming from the light engine 22 are not reflected on the front face 62 but rather inside the annular reflector 20, on its rear face 56.

According to the first variant (FIG. 12), the front face 62 of the reflector 20 is substantially smooth and of a generally parabolic shape.

The rear face 56 comprises a coating of reflective material and a series of reflection facets 126 that are generally produced in accordance with the same principle as the reflection facets 124 of FIG. 10.

The reflection facets 126 in this case form convex bosses on the rear face 56 of the reflector 20.

The mode of operation of the indicator lamp 10 according to the first variant (FIG. 12) is generally similar to that of the lamp 10 in FIG. 10.

The rays of light R5*r*, distributed in a generally transverse manner towards the annular reflector 20 by way of the outlet face 104 of the light engine 22, are refracted inside the reflector 20, through the front face 62, and then are reflected, towards the front, on the reflection facets 126 of the rear face 56, and finally are refracted, generally axially towards the front, through the front face 62.

It will be noted that the shape and orientation of the reflection facets 126 of the rear face 56 must be designed to take account of the deflection that the rays of light R5*r* undergo while being refracted twice through the front face 62, first from the front towards the rear and then from the rear towards the front.

According to the second variant (FIG. 13), the front face 62 of the reflector 20 is of a shape similar to that of the annular reflector 20 of FIG. 10, that is to say that it comprises elements 128 having a profile similar to the facets 124, but the front face 62 does not comprise a reflective coating.

The elements 128 form elementary dioptric patterns of the same type as the dioptric patterns 108 of the central diffusion face 106 of the light engine 22.

The rear face 56 of the annular reflector 20, which does not comprise a reflective coating, comprises catadioptric patterns 130 having two faces, which are similar to the catadioptric patterns 110 of the light engine 22.

The catadioptric patterns 130 of the reflector 20 do not comprise a truncation, and their two faces in this case describe an angle $\beta$ of around ninety degrees with respect to one another.

The mode of operation of the indicator lamp 10 according to the second variant (FIG. 13) is generally similar to that of the lamp 10 of FIG. 12.

The rays of light R5*r*, distributed generally transversely towards the annular reflector 20 by way of the outlet face 104 of the light engine 22, are refracted inside the reflector 20, through the dioptric patterns 128 of its front face 62, and then are reflected on the two faces of a catadioptric pattern 130 of the rear face 56 and finally are refracted, generally axially towards the front, through the dioptric patterns 128 of the front face 62.

One advantage of this second variant is that it does not require a reflective coating on the annular reflector 20, which acts on the rays of light R5*r* solely by refraction and by total reflection inside the material.

It will be noted that the optical part 12 of the indicator lamp 10 according to the second embodiment is preferably produced in two parts, the light engine 22 being moved back with respect to the reflector 20, as shown in the figures, so as to facilitate the production of the optical part 12 by moulding.

Figure 14:
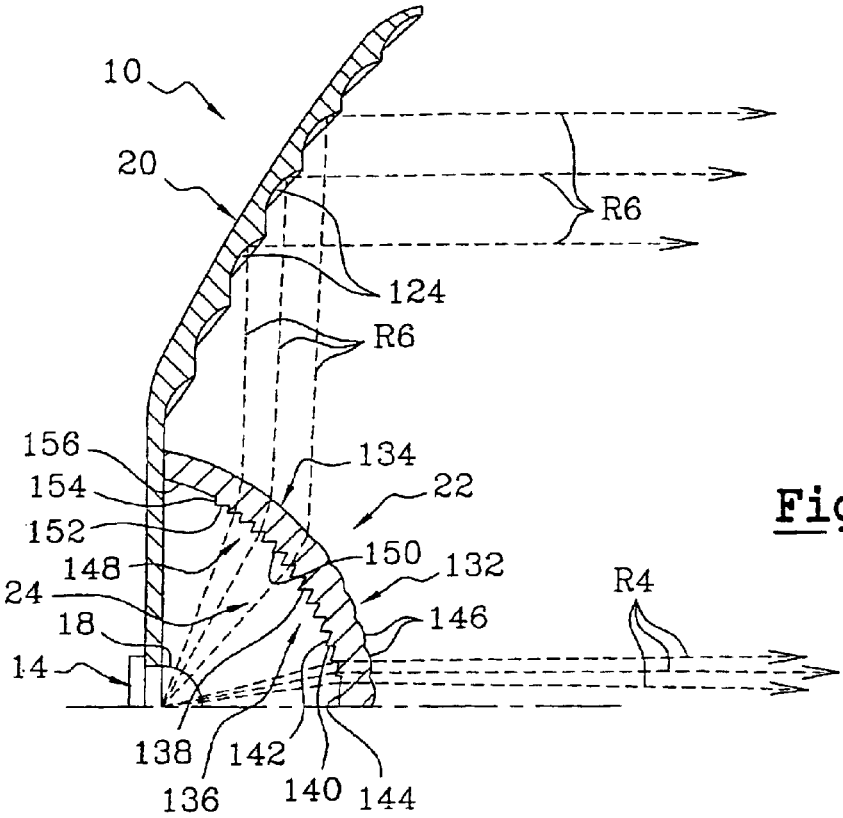
FIG. 14 is a view similar to that of FIG. 12, which schematically shows an indicator lamp equipped with a light engine according to a third embodiment of the invention.

FIG. 14 shows an indicator lamp 10 which is produced in accordance with a third embodiment of the invention.

This third embodiment comprises a coaxial annular reflector 20 which is, for example, of the same type as that described with reference to the second embodiment and to FIG. 10. The coaxial annular reflector 20 therefore comprises a series of reflection facets 124 arranged in the form of echeloned annuluses.

The third embodiment differs primarily in its light engine 22, which generally has the shape of a hollow hemispherical globe centred on the light source 14. The shape of the light engine 22 is in this case similar to that of an optical device known as a bonnet, which is commonly used in indicator lamps.

The concave rear face of the light engine 22 forms the inlet face 24 for the rays of light emitted by the source 14.

The convex front face of the light engine 22 forms, in its central part, a light diffusion face 132 and, in its peripheral part, an outlet face 134.

The inlet face 24 comprises a central zone 136 that forms a Fresnel lens. The central zone 136 of the inlet face 24 therefore comprises annular echelons 138 that are coaxial with the axis A—A.

Each of the echelons 138 of the central zone 136 comprises a first generatrix 140 that is substantially parallel to the axis A—A, and a second generatrix 142 that is inclined with respect to the axis A—A.

The closer the echelon 138 is to the axis A—A, the closer the inclined generatrix 142 is to a radial direction.

The portion 144 of the central zone 136 that is closest to the axis A—A has a substantially radial profile.

The light diffusion face 132 is arranged substantially axially opposite the central zone 136. It comprises elementary dioptric patterns 146, for example of convex profile, that are provided for spatially distributing towards the front the rays of light received by the central zone 136, so as to produce elementary light beams the shape of which is suited to the indicating function to be provided.

The elementary dioptric patterns 146 are, for example, similar to the dioptric patterns 108 that were described with reference to the second embodiment (FIG. 10).

The inlet face 24 comprises a peripheral annular zone 148 that comprises coaxial annular echelons 150, similar to the echelons 138 of the central zone 136.

The echelons 150 of the peripheral annular zone 148 in this case comprise a generatrix 152 that is substantially parallel to the axis A—A, and a generatrix 154 that is inclined with respect to the axis A—A.

The further away one moves from the axis A—A, the more the inclination of the generatrix 154 increases and approaches a radial direction.

The peripheral annular zone 148 comprises a peripheral end portion 156 of substantially hemispherical shape.

The outlet face 134 of the light engine 22 is associated with the peripheral annular zone 148 of the inlet face 24. In this case, it has a generally hemispherical profile and is arranged generally radially opposite an axial section of the coaxial annular reflector 20.

The mode of operation of this third embodiment is as follows.

The light diode 14 emits rays of light towards the inlet face 24 of the light engine 22.

A first part R4 of the rays of light, those which are closest to the optical axis A—A, strike the central zone 136 of the inlet face 24. These rays R4 are refracted through the light engine 22 to the light diffusion face 132, which transmits them generally axially towards the front, forming elementary indicating beams, by virtue of the dioptric patterns 146.

A second part R6 of the rays of light strike the peripheral annular zone 148 of the inlet face 24. These rays R6 are refracted through the peripheral annular zone 148 and then through the outlet face 134, which distributes them in a suitable manner towards the reflection facets 124 of the coaxial annular reflector 20.

As for the preceding embodiments, the coaxial annular reflector 20 distributes the rays of light R6 axially towards the front, so as to produce an indicating beam that meets the regulations.

Generally, the rays R6, which strike the end portion 156 of the peripheral annular zone 148, are not deflected by the light engine 22, since they pass through two hemispherical profiles (136 then 134) that are centred on the light source 14.

It will be noted that the rays of light R4, which strike the central zone 136, are refracted towards the front through the inclined portions 142 of the echelons 138. The axial portion 140 of the echelons 138 is generally neutral in optical terms, since it is not provided to transmit rays of light.

By contrast, with regard to the rays of light R6 which strike the peripheral annular zone 148, these are refracted towards the outlet face 134 through the axial portions 152 of the echelons 150. The inclined portion 154 of the echelons 150 is therefore generally neutral in optical terms, since it is not provided to transmit rays of light.

Figure 15:
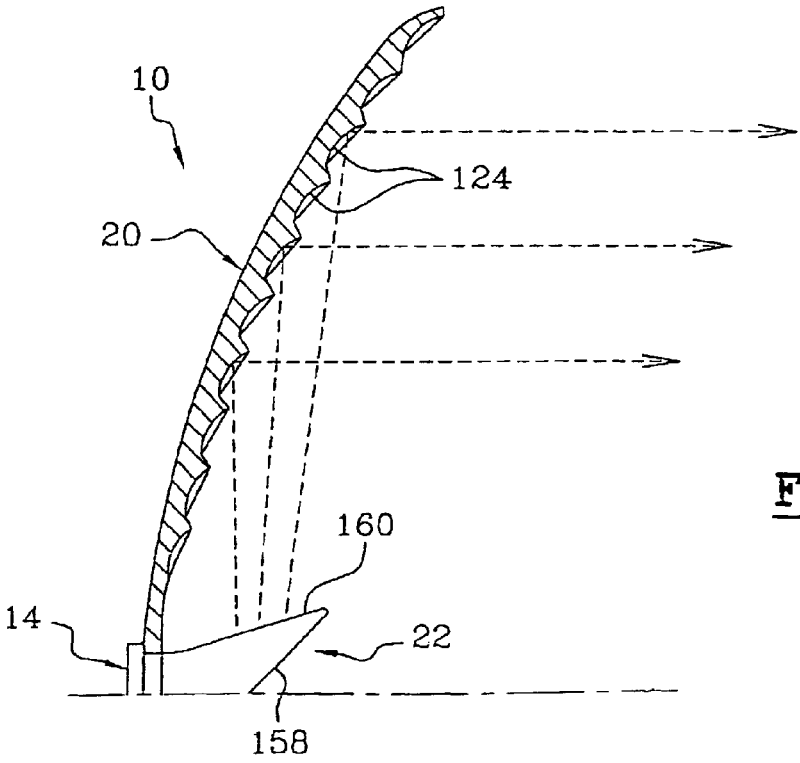
FIG. 15 is a view similar to that of FIG. 12, which schematically shows an indicator lamp equipped with a light engine according to a fourth embodiment of the invention.

FIG. 15 shows an indicator lamp 10 which is produced in accordance with a fourth embodiment of the invention.

According to this embodiment, the optical device that forms the light engine 22 is integrated in the light source, in this case in the light-emitting diode 14.

The light diffusion globe 18 is therefore replaced by a light engine 22 having a shape that is appropriate for distributing the rays of light generally radially towards the coaxial annular reflector 20.

The light engine 22 may take various shapes, such as the shapes described with reference to the preceding embodiments.

The light engine 22 in this case has a generally frustoconical shape, the vertex of which is arranged at the rear.

The frustum of the cone forming the light engine 22 has for example an opening of between 40 and 120° with respect to the optical axis A—A.

The light engine 22 comprises a front reflection face 158 of conical shape, and a frustoconical outlet face 160 which is arranged generally radially opposite an axial section of the reflector 20.

The indicator lamp 10 in this case comprises a coaxial annular reflector 20 which is similar to that described with reference to the second embodiment (FIG. 10).

The rays of light emitted by the diode 14 are reflected inside the light engine 22, on the front face 158, by total reflection, and then are refracted through the outlet face 160, which distributes them towards the reflection facets 124 of the coaxial annular reflector 20.

This embodiment makes it possible in particular to produce the light engine 22 in a single piece with the diode 14, which reduces the number of parts needed to produce the indicator lamp 10.

The indicator lamp 10 according to the invention, in particular the various embodiments described above, have numerous advantages.

It will be noted that the indicator lamp 10 according to the invention makes it possible to simplify the injection of material and to reduce the injection time, when producing the optical part 12 by moulding.

Moreover, the indicator lamp 10 according to the invention requires a small amount of material and a small thickness of material, in order to produce the optical part 12, compared with the indicator lamps using conventional light conduits.

Another advantage of the invention is that the indicator lamp 10 is autonomous in optical terms, that is to say that it can provide an indicating function that meets the regulations without requiring the addition of another light distribution device, such as a ridged diffusion mirror.

Of course, the indicator lamp 10 is preferably arranged behind a sheet of protective glass, which may be neutral in optical terms.

Yet another advantage of the invention is that it is possible to produce several indicator lamps 10 of different shapes, in particular in terms of the external shape, by modifying only the shape of the reflector 20, while using the same light engine 22. This makes it possible to standardize the parts of the indicator lamp 10 and to reduce the manufacturing costs of the indicator lamp 10.

What is claimed is:

1. An indicator lamp, for a motor vehicle, comprising:

a light source arranged along an optical axis oriented from the rear to the front of the indicator lamp for emitting light rays toward the front, at a solid angle centered on the axis; and an optical device for recovering and distributing the rays of light emitted by the source for providing, toward the front, an indicating function, the optical device having: a coaxial annular reflector; and a light engine in front of the light source for distributing the rays of light emitted by the light source in directions that are generally transverse about the optical axis, toward the coaxial annular reflector that is provided for distributing the rays of light, coming from the light engine, toward the front, generally in a direction parallel to the optical axis, so as to provide the indicating function, said light engine being made of a transparent material having a refractive index greater than that of air, and having:

an inlet face which is arranged axially opposite the light source and having a profile, in axial section, such that most of the rays of light emitted by the source penetrate into the light engine;

an outlet face which is arranged generally radially opposite at least one axial section of the coaxial annular reflector;

at least one front inner reflection face which is provided to deflect at least part of the rays of light that enter the light engine, toward the outlet face, such that the rays of light leave the light engine by way of the outlet face by being refracted, and such that these rays of light strike the coaxial annular reflector at given angles of incidence; and a rear inner reflection face of concave parabolic annular shape, which is focused on the light source and which reflects the rays of light axially toward the front.

2. An indicator lamp according to the claim 1, wherein the light engine comprises a front inner reflection face of convex parabolic annular shape, which is arranged axially opposite the rear reflection face and which is designed to cause the reflection of the rays of light, reflected by the rear reflection face, in a given direction toward an associated section of the outlet face.

3. An indicator lamp according claim 2, wherein the section of the outlet fece that is associated with the parabolic front reflection face has a convex hemispherical annular shape which is centered on a focus of the associated parabola such that the rays of light reflected by the parabolic front reflection face pass through the outlet face in a substantially orthogonal maimer.

4. An indicator lamp according to claim 1. wherein the light engine comprises a conical or frustoconical front reflection face which is centered on the optical axis such thaI the axial rays of light, which are reflected by the conical front face, strike the outlet face at an angle of incidence that is determined by the value of the angle at the vertex of the conical faces.

5. An indicator lamp according to claim 4, wherein the angle at the vertex of the conical face is snbstantially equal to ninety degrees, and wherein the portion of the outlet face that is arranged radially opposite the conical face is substantially cylindrical, so that the rays of light reflected by the conical face pass through the outlet face in a substantially radial direction.

6. An indicator lamp according to claim 2, wherein at least one axial section of a front reflection face is obtained by anamorphosis, for producing a spatial distribution of the rays of light transmitted toward the reflector for providing a given indicating fimction.

7. An indicator lamp according to claim 1, wherein the light engine comprises a peripheral annular portion which extends transversely outwards and which comprises a front outlet face provided with coaxial circular ridges along the optical axis, the ridges forming diopters designed to refract, axially toward the front, the rays of light coming from the inlet face.

8. An indicator lamp according to claim 1, wherein the light engine comprises a front reflection face which is provided with catadioptric patterns that are designed to reflect, the rays of light coming from the rear reflection face, toward the outlet face in a direction that is substaetially orthogonal to the outlet face.

9. An indicator lamp according to claim 8, wherein the outlet face is at least partly coincident with, the rear reflection face.

10. An indicator lamp according to claim 8, wherein each catadioptric pattern comprises two inclined faces which between them form an angle of given value, said faces being arranged with respect to the optical axis such that each ray parallel to the optical axis that strikes a catadioptric pattern is reflected on one of the two faces and then on the opposite face before being transmitted toward the outlet face.

11. An indicator lamp according to claim 10, wherein each catadioptric pattern is truncated in the vicinity of the vertex of the angle formed by the two inclined faces, such that part of the rays of light that strike the catadioptric pattern are refracted toward the front, through the truncation.

12. An indicator lamp according to claim 1, wherein the front reflection face has a coaxial annular shape, and wherein the light engine comprises a front central outlet face adjacent to the front reflection face, which is provided to refract the rays of light, coming from the light source, directly toward the front.

13. An indicator lamp according to claim 12, wherein the front central outlet face comprises a series of elementary dioptric distribution elements which are provided so as to each form, from the rays of light passing through them, an elementary light beam that is directed toward the front.

14. An indicator lamp according to claim 1, wherein the inlet face of the light engine comprises a concave hemispherical portion which is centered on the light source.

15. An indicator lamp according to claim 1, wherein the inlet face comprises a central portion that forms a collimator, so as to refract the rays of light axially toward the front.

16. An indicator lamp according to claim 1, wherein the light engine is made of a transparent material having a refractive index greater than that of air, and wherein the light engine comprises:

a generally hemispherical inlet face which is centered on the light source and which comprises coaxial annular echelons provided for deflecting the rays of light by means of refraction;

an outlet face which is arranged generally radially opposite at least one axial section of the coaxial annular reflector, such that the rays of light leave the light engine by way of the outlet face by being refracted, and such that these rays of light strike the coaxial annular reflector at given angles of incidence.

17. An indicator lamp according to claim 16, wherein the outlet face of the light engine has a generally hemispherical shape centered on the source.

18. An indicator lamp according to claim 16, wherein the light engine comprises a light diffusion face which is arranged axially opposite a central zone of the inlet face, so as to disfribute, generally axially toward the front, part of the rays of light emitted by the source.

19. An indicator lamp according claim 1, wherein the front face of the coaxial annular reflector is reflective, and wherein the front face comprises at least one axial section that is parallel to an associated axial section of the front reflection face of the light engine.

20. An indicator lamp according to claim 1, wherein the front face of the reflector is reflective, and wherein the front face comprises a series of elementary reflection facets that are oriented, with respect to the angle of incidence of the rays of light coming from the light engine, so as to reflect the rays of light, generally axially toward the front, thereby each forming an elementary light beam, the image of which, on a screen placed in front of the indicator lamp, corresponds to the indicating fanction to be provided.

21. An indicator lamp according to claim 20, wherein the from face of the reflector is echeloned axially toward the front and transversely outwards.

22. An indicator lamp according to claim 1, wherein:

the coaxial annular reflector is made of a transparent material having a refractive index greater than that of air;

the profile of the front face of the reflector, with respect to the angle of incidence of the rays of light coming from the light engines, is such that said rays of light are refracted inside the reflector when they strike the front face of the reflector; and the rear face of the reflector is configured to reflect said rays of light toward the front, such that they are refracted through the front face in a generally axial direction.

23. An indicator lamp according to claim 22, wherein the rear face of the reflector comprises a reflective coating.

24. An indicator lamp according claim 23, wherein the rear face of the reflector comprises a series of elementary reflection facets that are oriented in a given manner, with respect to the angle of incidence of the rays of light that are refracted inside the reflector through the front face.

25. An indicator lamp accordine to claim 22, wherein the front face of the reflector comprises generally axial portions, which are arranged substantially orthogonally with respect to the direction of the rays of light coming from the light engine, and generally radial portions, which are located between two axial portions, and in that the rear face of the reflector comprises axial sections that are substantially parallel to the associated sections of the front reflection face of the light engine, such that die rays of light coming from the light engine:

are refracted through the axial portions toward the inside of the reflector, without being deflected, then are reflected, axially toward the front, on the rear face of the reflector, then are refracted through the radial portions, toward the outside of the reflector, generally axially toward the front.

26. An indicator lamp according to claim 22, wherein the rear face of the reflector comprises a series of catadioptric patterns having two faces, such that the rays of light coming from the light engine are refracted firough the from face of the reflector, toward the inside of the reflector, then are reflected twice on a catadioptric pattern so as to be directed toward the front, and then are refracted through the front face of the reflector, toward the outside of the reflector, generally axially toward the front.

27. An indicator lamp according to claim 25, wherein the front face of the reflector comprises a series of elementary dioptric distribution elements which are designed to refract the rays of light, coming from the rear face of the reflector thereby forming elementary light beams directed toward the front, the image of which, on a screen placed in front of the indicator lamp, corresponds to the indicating function to be provided.

28. An indicator lamp according to claim 1, wherein the light engine is integrated in the light source.

29. An indicator lamp having an optical axis extending from a first end portion to a second end portion, the lamp comprising:

a light source disposed so as to emit light rays toward the second end portion along said axis;

a coaxial annular reflector; and a light engine disposed downstream of the light source for distributing said light rays in directions that are generally transverse about the optical axis toward the coaxial annular reflector, the light engine being made of a transparent material having a refractive index greater than that of air, the light engine including:

an inlet face which is arranged axially opposite the light source and having a profile in axial section, is such that most of the rays of light emitted by the source penetrate into the light engine;

an outlet face which is arranged generally radially opposite at least one axial section of the coaxial annular reflector;

at least one front inner reflection face which is provided to deflect at least part of the rays of light that enter the light engine toward the outlet face, such that the rays of light leave the light engine by way of the outlet face by being refracted, and such that these rays of light strike the coaxial annular reflector at given angles of incidence; and a rear inner reflection face of concave parabolic annular shape, which is focused on the light source and which reflects the rays of light axially toward the front.

* * * * *

UNITED STATES PATENT AND TRADEMARK OFFICE

CERTIFICATE OF CORRECTION

PATENT NO. : 6,953,271 B2
DATED : October 11, 2005
INVENTOR(S) : Aynié et al.

It is certified that error appears in the above-identified patent and that said Letters Patent is hereby corrected as shown below:

Column 18,
Line 16, “conical faces” should read -- conical face --;
Line 43, “with, the” should read -- with the --.

Column 19,
Line 27, “disfribute” should read -- distribute --;
Line 42, “fanction” should read -- function --;
Line 52, “light engines” should read -- light engine --.

Column 20,
Line 7, “that die rays” should read -- that the rays --;
Line 18, “firough the from face” should read -- through the front face --.

Signed and Sealed this

Thirteenth Day of June, 2006

JON W. DUDAS
*Director of the United States Patent and Trademark Office*